United States Patent [19]

Bornstein et al.

[11] Patent Number: 4,921,122

[45] Date of Patent: May 1, 1990

[54] SLIDE BAR LOCKING ARRANGEMENT

[75] Inventors: Marvin Bornstein, Northbrook; Corney J. Ewert, Oak Park; John D. Saenger, Wood Dale; Vincent Reyes, Roselle, all of Ill.

[73] Assignee: Metal Box Corporation, Franklin Park, Ill.

[21] Appl. No.: 436,110

[22] Filed: Nov. 16, 1989

Related U.S. Application Data

[63] Continuation of Ser. No. 222,176, Jul. 21, 1988, abandoned.

[51] Int. Cl.[5] ..... A45C 11/00

[52] U.S. Cl. ..... 220/326; 70/70; 292/174

[58] Field of Search ..... 220/326; 70/70; 292/30, 292/31, 169, 174, 175, 302, DIG. 42

[56] References Cited

U.S. PATENT DOCUMENTS 1,585,799 5/1926 Stone ..... 70/70

4,693,346 9/1987 Eversdijh ..... 292/DIG. 42

*Primary Examiner*—John C. Fox

*Attorney, Agent, or Firm*—Lee, Mann, Smith, McWilliams & Sweeney

[57] ABSTRACT

A slide bar locking arrangement for securing a lid to a cabinet to prevent unauthorized access. Hook members extending from the underside of the lid are received in and engage a plurality of corresponding apertures defined in a resiliently biased slide bar slidably mounted adjacent an inner wall of the cabinet, thereby securing the lid to the cabinet. During closing of the lid, the sides of the hook members contact the sides of the apertures causing the slide bar to move laterally until the hooks are secured in the apertures. A knob attached to the slide bar extends outside the cabinet and is operable to move the slide bar out of engagement with the hook members so that the lid may be opened. A lock mechanism is provided to secure the slide bar against movement so that the lid cannot be opened until the lock mechanism is unlocked.

6 Claims, 2 Drawing Sheets

SLIDE BAR LOCKING ARRANGEMENT

This application is a continuation of application Ser. No. 222,176, filed July 21, 1988 now abandoned.

BACKGROUND OF THE INVENTION

The present invention provides a slide bar locking arrangement for securing the lid of a cabinet in a closed position to prevent unauthorized access. Numerous arrangements of this general type are shown in the prior art U.S. Pat. Nos. 3,360,318, 3,521,937, 4,298,236, 4,457,569 and 4,478,466. None of the foregoing patents discloses the features of the present invention.

SUMMARY OF THE INVENTION

The present invention provides a slide bar locking arrangement for releasably securing the lid of a cabinet in a closed position. The arrangement includes a plurality of hook members which extend downwardly from the underside of the lid. When the lid is closed, the hook members extend into the interior of the cabinet. A slide bar, operable between a locked and an unlocked position, is slidably mounted on the interior of the front wall of the cabinet and is adapted to cooperate with the hook members to releasably secure the lid to the cabinet. The slide bar is provided with a plurality of apertures sized and located to receive the corresponding hook members. A spring is connected between the cabinet and the slide bar to urge the slide bar to its locked position. As the lid is closed, the hook members are slightly out of alignment with the apertures in the slide bar. The hook members contact the edges of the corresponding apertures to effect a camming action causing the slide bar to move sideways against the urging of the spring so that the hook members pass through the apertures. The slide bar then moves back to its locked position as a result of the spring force and the hook members engage the underside of the slide bar, thereby securing the lid to the cabinet. A knob, positioned outside the cabinet, is secured to the slide bar to move the slide bar from the locked position to the unlocked position so that the hook members may freely pass through the apertures when it is desired to lift the lid. A barrel lock, operable between a locked and an unlocked position, is associated with the slide bar and is operable from outside the cabinet to selectively lock the slide bar against movement.

DETAILED DESCRIPTION OF THE INVENTION

Figure 1:
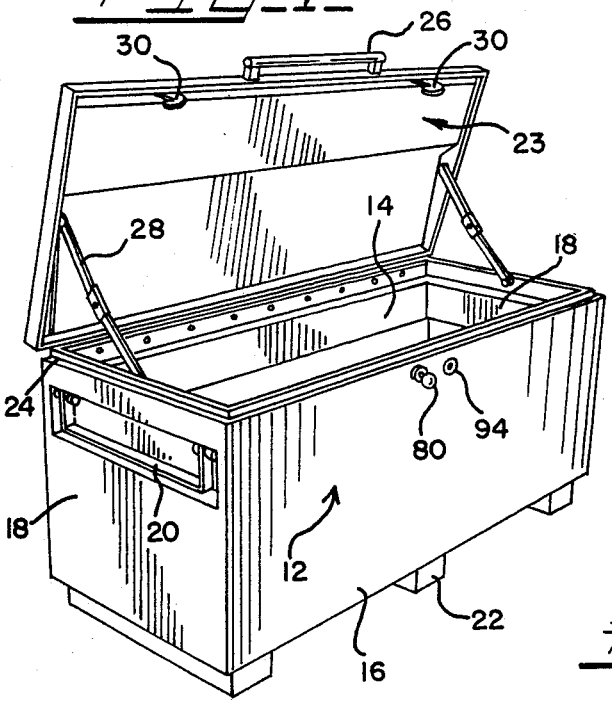
FIG. 1 shows a perspective view of a cabinet with a lid in the open position incorporating the locking arrangement of the present invention.

A slide bar locking arrangement, generally designated by the numeral 10 is shown in FIGS. 1–4. The locking arrangement 10 is adapted to secure a lid to a cabinet. As seen in FIG. 1, the cabinet 12 is substantially rectangular and has a rear wall 14, a front wall 16 and a pair of side walls 18. The cabinet 12 may be used to store tools or supplies or both at a jobsite or in the bed of a truck. Handles 20 are recessed into the side walls 18 to assist in moving the cabinet 12. The cabinet 12 is supported by a plurality of base members 22 sized and spaced to accommodate the prongs of a forklift truck therebetween so that the cabinet 12 may be lifted and moved. The lid 23 is hingedly connected to the top of the rear wall 14 of the cabinet 12 and is sized to cover and seal the cabinet 12 to preclude unauthorized access when the lid is closed. The lid 23 rests on a rim 24 positioned about the outer periphery of the upper edge of the cabinet 12. A handle 26 is provided on the lid 23 to assist in lifting it open. Gas springs (not shown) may be provided between the lid 23 and the cabinet 12 to help lift the lid 23. Lid supports 28 extend between the lid 23 and the side walls 18 of the cabinet 12 and lock rigidly into position to support the lid 23 when it is open and minimize the risk of the lid 23 accidentally dropping shut.

Figure 4:
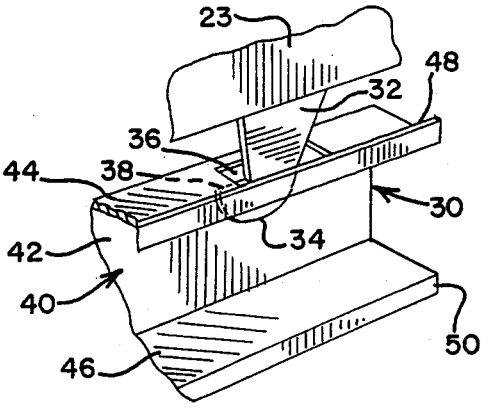
FIG. 4 shows a perspective sectional view of the hook member and slide bar of the present invention.

Two hook members 30A and 30B extend from the underside of lid 23 near the front edge. As best seen in FIG. 4, the hook member 30 defines a stem portion 32, a lower curved portion 34 and a groove 36 defining an engagement surface 38. Although two hooks are shown for purposes of illustration, other embodiments are contemplated which could utilize either a single hook or three or more hooks depending upon the size of the receptacle.

Figure 2:
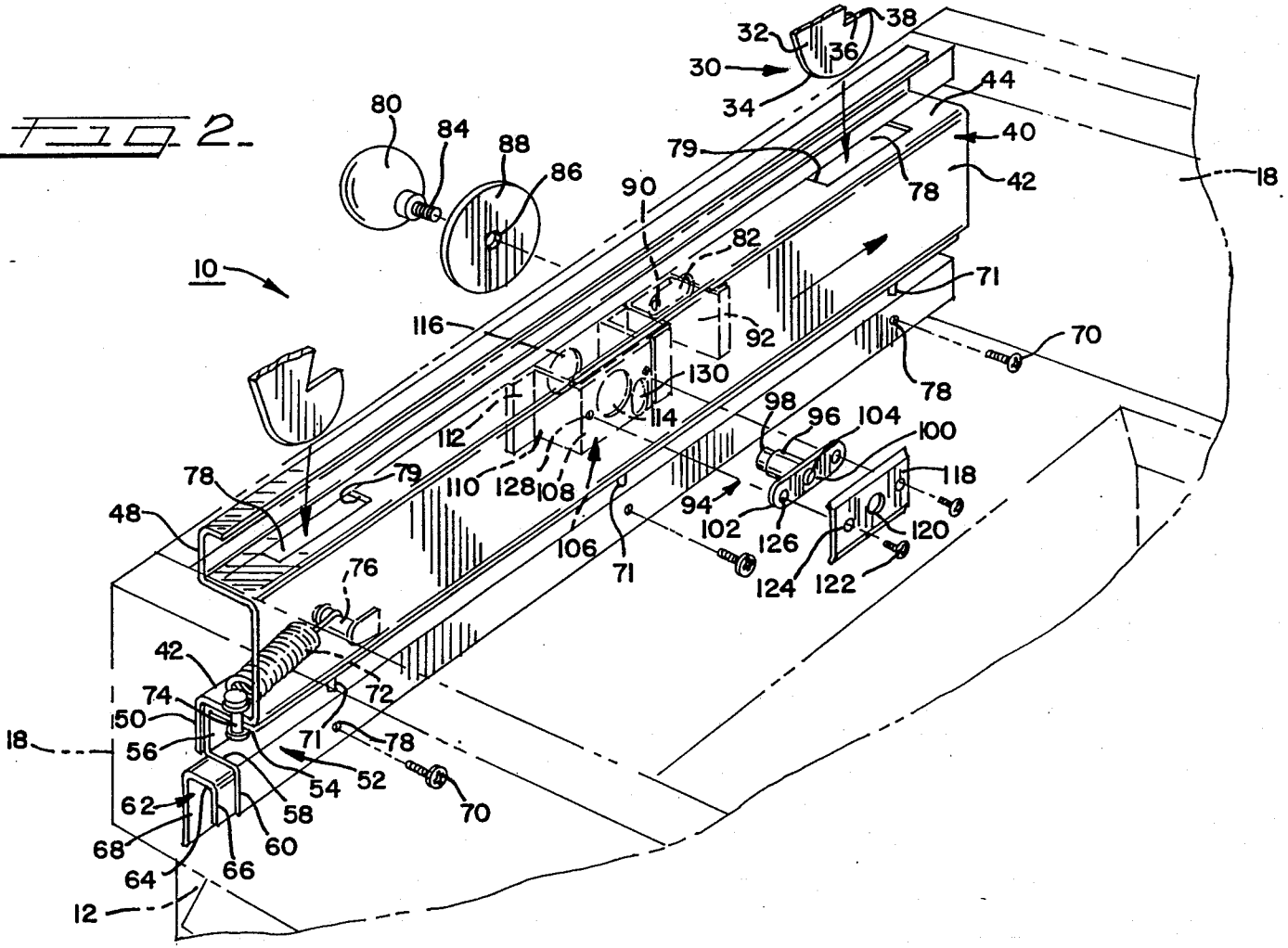
FIG. 2 shows a perspective view of the slide bar locking arrangement.

As best seen in FIG. 2, the slide bar locking arrangement 10 is located at the top of the inner front wall 16 of the cabinet 12. The locking arrangement 10 includes a slide bar 40 including a base portion 42, an upper side wall 44 and a lower side wall 46. Extending from the upper side wall 44 is an upper flange 48 and extending from the lower side wall 46 is a lower flange 50. The upper flange 48 is slidably retained in a recess defined at the upper edge of the front wall 16 of the cabinet 12 such that the upper and lower flanges 48 and 50 are positioned adjacent the inside of the front wall 16.

The slide bar 40 is supported by a first mounting bracket 52 including an upper wall 54, a side wall 56, a lower wall 58 and a further side wall 60. The lower side wall 46 of the slide bar 40 rests atop and adjacent and is adapted to slide horizontally along the upper wall 54 of the first mounting bracket 52. Side wall 56 of the bracket 52 lies adjacent to and in sliding contact with the lower flange 50 of the slide bar 40.

The first mounting bracket 52 is secured to and supported by a substantially inverted J-shaped second mounting bracket 62 defining a top surface 64, a rear face 66 and a front face 68. The second mounting bracket 62 is rigidly secured between the inner front wall 16 of the cabinet 12, the lower wall 58 of the first mounting bracket 52 and the side wall 60 of the first mounting bracket 52 such that the front face 68 of the second mounting bracket 62 lies adjacent to and in contact with the front wall 16 of the cabinet 12. The top surface 64 is disposed adjacent and beneath the lower wall 58 of the first mounting bracket 52, and its front face 68 is disposed adjacent the inside of the side wall 60 thereof. The first mounting bracket 52 is secured to the second mounting bracket 62 by a plurality of screws 70 which extend through the side wall 60 of the first mounting bracket 52 and through the front face 68 of the second mounting bracket 62. The slide bar 40 is horizontally slidable along the first mounting bracket 52. Nylon glide surfaces may be provided on the upper wall 54 of the first mounting bracket 52 to help the slide bar 40 slide easily therealong.

A coil spring 72 functions as a biasing mechanism and has one end secured to a pin 74 extending upwardly from the lower wall 58 of the first mounting bracket 52 and the other end secured to a pin 76 extending outwardly from the base portion 42 of the slide bar 40. The spring 72 acts to bias the slide bar 52 to the locked position, or to the left when viewing the slide bar 40 from the rear as shown in FIG. 2.

A number of substantially rectangular-shaped apertures 78A and 78B are defined in the upper side wall 44 of the slide bar 40. The actual number of apertures provided correspond to the number of hooks 30. The apertures 78A and 78B are sized to receive, respectively, the hook members 30A and 30B attached to the lid 23 and are spaced apart to correspond to the distance between the hook members 30A and 30B. However since the spring 72 biases the slide bar 40 in one direction, the apertures 78 are slightly misaligned with the hook members 30 for a purpose which will be described below.

A knob 80 is provided to move the slide bar against the force exerted by the spring 72. The knob 80 is located outside the front wall 16 of the cabinet 12 and is inserted through a slot 82 defined therethrough. The knob 80 is horizontally slidable in the slot 82. A screw portion 84, extending from the knob 80, is inserted through an aperture 86 located at the center of a substantially circular plate 88 and then through the slot 82 at the left side when viewing FIG. 2, such that the plate 88 is disposed between the knob 80 and the outside of the front wall 16 of the cabinet 12. The plate 88 moves with the knob 80 and is sized to cover the slot 82 at all times, no matter which direction the knob 80 is moved. The plate 88 prevents the entrance of water or other contaminants into the locking arrangement 10 and cabinet 12. The screw portion 84 continues through an aperture 90 defined in the face of a bracket 92 and is fastened thereto. The bracket 92 is rigidly secured to the inside of the base portion 42 of the slide bar 40. Hence, the knob 80 is connected to the slide bar 40 and is operable to move it.

A barrel lock 94 is associated with the slide bar 40 and acts as a positive or dead bolt lock to prevent the slide bar 40 from moving horizontally along the first mounting bracket 52. The lock 94 is operable between a locked position, whereby the slide bar 40 is prevented from moving horizontally with respect to the cabinet 12, and an unlocked position, whereby the slide bar 40 is horizontally movable against the spring force with respect to the cabinet 12. A circular key (not shown) is used to unlock the lock 94.

The lock 94 includes a substantially cylindrical barrel portion 96, a button locking member 98 and a locking extension member 100. The button locking member 98 is substantially cylindrical and has a smaller diameter than the barrel portion 96. It is centrally mounted in the front end of the barrel portion 96 and is slidably movable therein between an extended or unlocked position and a retracted or locked position. The locking extension member 100 is also substantially cylindrical, of smaller diameter than the barrel portion 96, is centrally mounted in the barrel portion 96 at the end opposite the button locking member 98, and is likewise slidably movable between a retracted or unlocked position and an extended or locked position. The locking extension member 100 is adapted to act in concert with the button locking member 98, such that when the button locking member 98 is in the extended or unlocked position, the locking extension member 100 is in the retracted or unlocked position, and when the button locking member 98 is in the retracted or locked position, the locking extension member 100 is in the extended or locked position. The operation of the lock 94 will be described further below.

The barrel portion 96 of the lock 94 is centrally mounted on a substantially oval-shaped mounting plate 102. The mounting plate 102 has defined therein an aperture 104 aligned with and sized to receive the locking extension member 100 when it is in its extended or locked position.

The lock 94 is mounted to a mounting bracket 106 disposed within the slide bar 40. The mounting bracket 106 is provided with a rear face portion 108 having a pair of side portions 110 extending outwardly therefrom, each side portion 110 defining a corresponding flange portion 112. The flange portions 112 are securely fastened to the inside of the front wall 16 of the cabinet 12. The rear face portion 108 is disposed adjacent to, but not in contact with, the inside of the base portion 42 of the slide bar 40. An aperture 114 is provided through the rear face portion 108 of the mounting bracket 106 and is sized to receive the lock 94 therethrough. A corresponding aperture 116 is defined through the front wall 16 of the cabinet 12 in alignment with the aperture 114 in the rear face portion 108 of the mounting bracket 106. The lock 94 extends through the mounting bracket 106 and out the aperture 116 in the cabinet 12, such that the button locking member 98 and a portion of the barrel portion 96 extend outwardly from the front wall 16 of the cabinet 12.

A reinforcement plate 118 is disposed adjacent the rear of the mounting plate 102. The reinforcement plate 118 will help protect the lock 94 from being punched out by persons not authorized to open the cabinet 12. The reinforcement plate 118 is substantially rectangular-shaped and approximately the same size as the rear face portion 108 the mounting bracket 106. An aperture 120 is centrally defined in the reinforcement plate 118 so as to correspond to the aperture 104 in the mounting plate 102 to permit receipt of the locking extension member 100 of the lock 94 therethrough. The reinforcement plate 118, mounting plate 102 and mounting bracket 106 are secured together by means of screws 122 inserted through respective apertures 124, 126 and 128 defined therethrough.

A substantially oval-shaped, vertically extending slot 130 is defined through the base portion 42 of the slide bar 40. The slot 130 is aligned with the aperture 124 in the reinforcement plate 118 and is sized to receive the locking extension member 100 of the lock 94 therethrough.

The operation of the slide bar locking arrangement 10 of the present invention is as follows. When the lid 23 is lowered, the curved portion 34 of the hook member 30 contacts the edge 79 of the aperture 78 and acts as a cam to urge the aperture 78, and hence the slide bar 52, to the right when viewing FIG. 2. The slide bar 40 moves to the right until the entire curved portion 34 of the hook member 30 passes through the aperture 78 and the engagement surface 38 of the hook member 30 is flush with the under surface of the upper side wall 44 of the slide bar 40. At this point, because of the biasing effect of the spring 72, the slide bar 40 slides back toward the left until the edge 79 of the aperture 78 contacts the stem portion 34 of the hook member 30. The engagement surface 38 of the hook member 30 is now completely disposed beneath the upper side wall 44 of the slide bar 40, thereby locking the hook members 30 to the slide bar 40 and consequently, the lid 23 to the cabinet 12.

When the lid 23 is in this closed position, the knob 80 is disposed at the left end of the slot 82. This is the normal position for the knob 80 when the lid 23 is opened or closed since the knob 80 is connected to the slide bar 40 and the slide bar 40 is biased to the left by the spring 72. Therefore, when it is desired to release the hook members 30 from the apertures 78 in the slide bar 40 to open the lid 23 and gain access to the cabinet 12, the knob 80 is moved toward the right, when viewing FIG. 2. This moves the slide bar 40 to the right until the engagement surfaces 38 of the hook members 30 are no longer disposed beneath the upper side wall 44 of the slide bar 40 and the hook members 30 on the lid 23 can be lifted out of the apertures 78 on the slide bar 40. After the hook members 30 are free and the knob 80 released, the slide bar 40 is urged back to the left, as is the knob 80.

Figure 3:
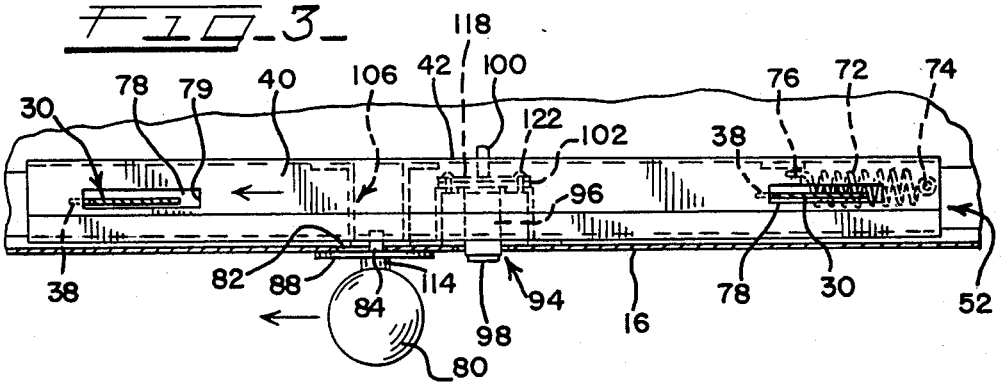
FIG. 3 shows a top view of the locking arrangement, of FIG. 2 in a locked position.

When the lock 94 is unlocked, the button locking portion 98 of the lock 94 is in the extended position and the locking extension member 100 is in the retracted position, as best seen in FIG. 2, such that it is substantially flush with the surface of the reinforcement plate 118. In this position, the knob 80 may be slid in the slot 82 to move the slide bar 40 to release the hook members 30 and open the cabinet lid 23, as described above. When it is desired to prevent access to the cabinet 12, the button locking portion 98 is pushed into the barrel portion 96, as with one's thumb, so that the button locking portion 98 is in the retracted position. Pushing the button locking portion 98 in causes the locking extension member 100 to move from the unlocked, retracted position to the locked, extended position, whereby the locking extension member 100 protrudes through the slot 130 in the slide member 40, as best seen in FIG. 3. This prevents the slide bar 40 from moving horizontally, because when the knob 80 is moved to operate the slide bar 40, the edges of the slot 130 contact the locking extension member 100 and prevent movement of the slide bar 40. The circular key is inserted into the button locking mechanism 98 and actuated to release it from the retracted position to the extended position and thereby move the locking extension member 100 from its locked, extended position to its unlocked, retracted position.

Although the above description of the present invention describes a horizontally operable embodiment of a slide bar locking arrangement, it is contemplated that the locking arrangement of the present invention also be used in vertical applications, as for example, with an upright cabinet having a door or doors which open outwardly.

Thus is has been shown that the present invention provides a slide bar locking arrangement to secure a lid to a cabinet. Various features of the invention have been particularly shown and described in connection with the illustrated embodiment of the invention, however, it must be understood that these particular arrangements merely illustrate and that the invention is to be given its fullest interpretation within the terms of the appended claims.

What is claimed is:

1. A slide bar locking arrangement for a storage receptacle having a lid, said slide bar locking arrangement including at least one hook member mounted on and extending from an underside of said lid, an elongated mounting bracket secured to an inner wall of said receptacle, a slide bar slidably supported by said mounting bracket and having a base portion disposed in spaced, parallel relation to said inner wall, a first side wall extending from one edge of said base portion, a second side wall extending from a second edge of said base portion, said side walls being spaced from and parallel to one another, and one of said sidewalls contacting said mounting bracket for sliding thereagainst, said side wall and said base portion forming a generally C-shaped configuration with said base portion being spaced from the inner wall of the receptacle, said slide bar being operable between a first position preventing said lid from opening and a second position allowing said lid to open, said first side wall of said slide bar having at least one aperture sized and positioned to receive said hook member when said slide bar is in said second position and to secure said hook member within said aperture when said slide bar is in said first position, biasing means connected between said slide bar and said storage receptacle to urge said slide bar into said first position, means located externally of said storage receptacle and attached to said slide bar for selectively moving said slide bar from said first position to said second position against the force of said biasing means, whereby said slide bar is normally biased to assume said first position wherein said aperture and said hook member are positioned slightly out of alignment so as to prevent passage of said hook member through said aperture and whereby, upon closure of said lid, said hook member contacts an edge of said aperture resulting in a camming force which urges said slide bar to overcome the force of said biasing means and move from said first position to said second position allowing said hook member to pass through said aperture, at which point said biasing means then returns said slide bar to its first position to secure said lid to said receptacle.

2. The slide bar locking arrangement of claim 1 including a lock mechanism associated with said slide bar and operable from outside said storage receptacle, said lock mechanism adapted to assume either a locked position, whereby said slide bar is secured against movement or an unlocked position, whereby said slide bar is movable between said first position and said second position.

3. The slide bar locking arrangement of claim 2 wherein said lock mechanism is a barrel lock, said barrel lock including an actuation member located outside said receptacle and locking extension member located within said receptacle, said actuation member adapted to actuate said locking extension member from a retracted, unlocked position to an extended, locking position, whereby said locking extension member protrudes through an aperture defined through said slide bar to prevent said slide bar from being moved from said first position to said second position.

4. The slide bar locking arrangement of claim 1 wherein said external means for moving said slide bar is a knob horizontally slidable in an aperture defined in said storage receptacle.

5. The slide bar locking arrangement of claim 1 including at least one guide post provided on said mounting bracket to permit said slide bar to glide easily along said mounting bracket.

6. The slide bar locking arrangement of claim 1 in which said second side wall is slidably supported by said mounting bracket.

* * * * *